US011982159B2

(12) United States Patent
Al-Mousa et al.

(10) Patent No.: US 11,982,159 B2
(45) Date of Patent: May 14, 2024

(54) WELLBORE PROTECTOR RAM

(71) Applicant: SAUDI ARABIAN OIL COMPANY, Dhahran (SA)

(72) Inventors: Ahmed A. Al-Mousa, Doha (SA); Bader M. Al-Ahmad, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/662,388

(22) Filed: May 6, 2022

(65) Prior Publication Data

US 2023/0358118 A1 Nov. 9, 2023

(51) Int. Cl.
*E21B 33/08* (2006.01)
*E21B 41/00* (2006.01)
*E21B 33/03* (2006.01)

(52) U.S. Cl.
CPC ..... *E21B 41/0021* (2013.01); *E21B 33/08* (2013.01); *E21B 33/03* (2013.01)

(58) Field of Classification Search
CPC .. E21B 41/0021; E21B 17/1021; E21B 33/06; E21B 33/062; E21B 33/068; E21B 33/08; E21B 33/085
See application file for complete search history.

(56) References Cited

U.S. PATENT DOCUMENTS 2,264,600 A * 12/1941 Webb ..... E21B 33/08 277/344
2,642,942 A * 6/1953 Reynolds ..... E21B 33/08 166/57
3,844,755 A * 10/1974 Angle ..... C03B 19/025 65/223
4,690,213 A * 9/1987 Stannard ..... E21B 33/062 166/82.1
6,059,052 A * 5/2000 Haggard ..... E21B 33/08 175/84
6,250,387 B1 6/2001 Carmichael et al.
7,798,466 B2 9/2010 Springett et al.
8,770,280 B2 7/2014 Buytaert et al.
9,359,853 B2 * 6/2016 Nas ..... E21B 3/00
9,903,183 B2 2/2018 DeRouen, Sr.
2013/0020096 A1 * 1/2013 DeRouen, Sr. ..... B03C 1/288 166/66.5
2017/0159381 A1 * 6/2017 Orban ..... E21B 19/165

FOREIGN PATENT DOCUMENTS

AU 2013313197 B2 10/2016
CA 2565135 C 9/2008

* cited by examiner

*Primary Examiner* — Tara Schimpf
*Assistant Examiner* — Jennifer A Railey
(74) *Attorney, Agent, or Firm* — Osha Bergman Watanabe & Burton LLP

(57) ABSTRACT

A wellbore protector ram device includes a plurality of blocks that move in a plane orthogonal to an extension direction of a drill string and block junk from passing through a body of the wellbore protector ram device. The wellbore protector ram further includes a plurality of pistons that actuate, thereby locking and preventing movement of the plurality of blocks, and a plurality of springs that press the plurality of blocks against the drill string when the plurality of blocks are unlocked. The body includes an opening and encases the plurality of pistons and a plurality of springs. The drill string passes through the opening of the body.

20 Claims, 7 Drawing Sheets

WELLBORE PROTECTOR RAM

BACKGROUND

In the oil and gas industry, hydrocarbon fluids are commonly found in hydrocarbon reservoirs. These hydrocarbon reservoirs are located far below the surface of the earth in porous rock formations. In order to access the hydrocarbon fluids, wells are drilled into the formations. While drilling or during daily operations of the well, equipment or junk often become lost or lodged within the well. Once lost or lodged in the well, this equipment or junk is referred to as a fish.

Typically, regular drill bits cannot drill through a fish. Should a fish fall into a well, a "fishing job" is required to remove the fish from the well, or otherwise clear the well of the fish. Consequently, fishing jobs are often unplanned and viewed as costly, non-productive time. Common fishing jobs include pulling the fish out of the well by operating fishing tools that latch onto the fish, or milling the fish to clear the well with the use of high strength milling tools.

SUMMARY

In general, in one aspect, embodiments disclosed herein describe a wellbore protector ram device that includes a plurality of blocks that move in a plane orthogonal to an extension direction of a drill string and block junk from passing through a body of the wellbore protector ram device. The wellbore protector ram further includes a plurality of pistons that actuate, thereby locking and preventing movement of the plurality of blocks, and a plurality of springs that press the plurality of blocks against the drill string when the plurality of blocks are unlocked. The body includes an opening and encases the plurality of pistons and a plurality of springs. The drill string passes through the opening of the body.

In general, in one aspect, embodiments disclosed herein describe a method involving actuating a plurality of pistons of a wellbore protector ram device, the plurality of pistons being operatively connected to a plurality of blocks. Actuating the plurality of pistons results in locking and preventing movement of the plurality of blocks. The method further includes passing a drill string through an opening of a body of the wellbore protector ram device, the body encasing the plurality of pistons and a plurality of springs. In addition, the method includes pressing the plurality of blocks against the drill string in a plane orthogonal to an extension direction of the drill string by the plurality of springs when the plurality of blocks are unlocked. The plurality of blocks block junk from passing through the body of the wellbore protector ram device.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a well. In this respect, the term "upper" denotes an element disposed closer to the surface of the Earth than a corresponding "lower" element when in a downhole position, while the term "lower" conversely describes an element disposed further away from the surface of the well than a corresponding "upper" element. Likewise, the term "axial" refers to an orientation substantially parallel to the well, while the term "radial" refers to an orientation orthogonal to the well.

This disclosure describes devices and methods of protecting a well from falling junk by covering an annulus of the well with a plurality of moveable blocks. The techniques discussed in this disclosure are beneficial in preventing a need for fishing jobs, as well as keeping the drill string of the well clean.

Figure 1:
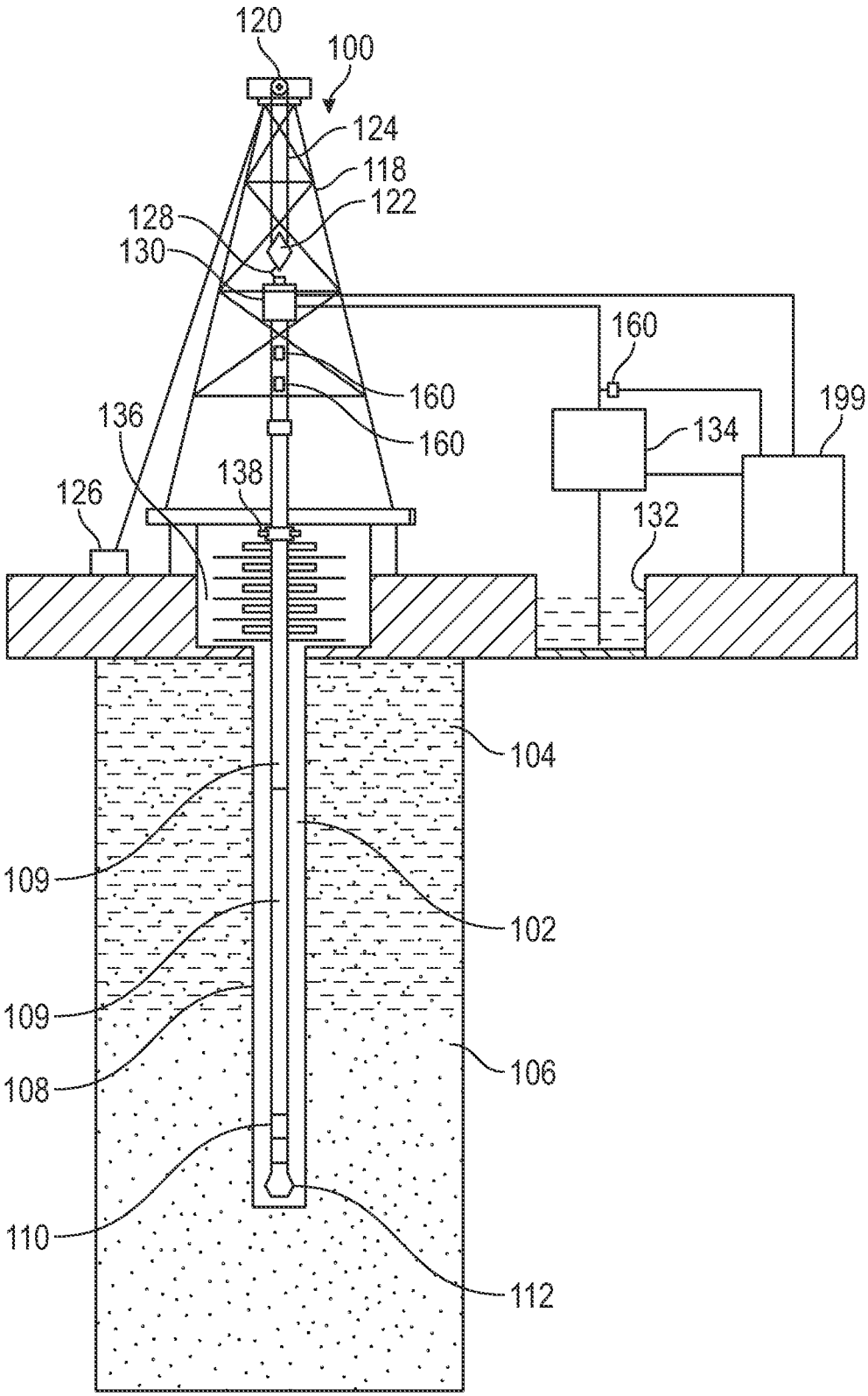
FIG. 1 shows an exemplary well site in accordance with one or more embodiments of the present disclosure.

FIG. 1 depicts an exemplary well site 100 in accordance with one or more embodiments. In general, well sites 100 may be configured in a several different ways. Therefore, the illustrated well site 100 of FIG. 1 is not intended to be limiting with respect to the particular configuration of the drilling equipment. The well site 100 is depicted as being on land. In other examples, the well site 100 is located offshore, and a marine riser is utilized for drilling. In this example, a drilling operation at well site 100 includes drilling a wellbore 102 into a subsurface including various formations 104, 106. A drill string 108 is suspended within the wellbore 102 for the purpose of drilling a new section of wellbore 102.

The drill string 108 is made of several steel drill pipes 109 connected to form a conduit. Situated at the distal end of the conduit is a bottom hole assembly (BHA) 110. The BHA 110 includes a drill bit 112 for cutting into the various formations 104, 106. In addition, the BHA 110 may also include measurement tools that have sensors 160 and hardware to measure downhole drilling parameters, and these measurements may be transmitted to the surface using any suitable telemetry system known in the art. Further, the BHA 110 and the drill string 108 may include other drilling tools known in the art but not specifically shown.

The drill string 108 is suspended in the wellbore 102 by a derrick structure 118. Mounted at the top of the derrick structure 118 is a crown block 120. A traveling block 122 hangs down from the crown block 120 via a drilling line 124. Connected to one end of the drilling line 124 is a drawworks 126. The drawworks 126 is a reeling device used to adjust the length of the drilling line 124 so that the traveling block 122 is capable of moving up or down the derrick structure 118. Additionally, the traveling block 122 includes a hook 128 on which a top drive 130 is supported.

The top drive 130 is coupled to the top of the drill string 108 in order to rotate the drill string 108. During a drilling operation at the well site 100, subsurface rock is broken by rotating the drill string 108 relative to the wellbore 102 and applying weight to the drill bit 112. Drilling fluid (often referred to as mud) is stored in a mud pit 132, and at least one pump 134 may pump the mud from the mud pit 132 into the drill string 108. The mud flows into the drill string 108 through appropriate flow paths in the top drive 130. Details of the mud flow path have been omitted for simplicity but would be understood by a person skilled in the art.

Here, a control system 199 is disposed at and communicates with the well site 100. The control system 199 controls at least a portion of a drilling operation at the well site 100 by providing commands to various components of the drilling operation. The control system 199 is capable of receiving data from one or more sensors 160 arranged to measure controllable parameters of the drilling operation. Sensors 160 may be arranged to measure WOB (weight on bit), RPM (drill string 108 rotational speed), GPM (flow rate of the mud pumps 134), ROP (rate of penetration of the drilling operation), and other measurements that might be appropriate and understood by a person skilled in the art.

A blowout preventer (BOP) 136 may be installed at the top of the wellbore 102. A BOP 136, as one skilled in the art will be aware, refers to an array of one or more pipe rams at the top of the wellbore 102 that are configured to be closed if the drilling crew loses control of formation fluids. Closing the rams may increase the density of the mud, thereby retaining pressure control of the formation and allowing the drilling crew to regain control of the reservoir.

While drilling the wellbore 102, as described above, various pieces of equipment may become disconnected or fall from the surface location of the well site 100 (surface portion being on or above the surface of the Earth) and become lost in the downhole portion of the well site 100 (downhole portion being anywhere beneath the surface of the Earth). Equipment or junk that is lost or lodged downhole is called a fish. Commonly, a fish originates from a drilling operation as described above, such as the drill bit 112 or a portion of the drill string 108, but may be any other operation equipment without departing from the scope of this disclosure.

The fish may be fished or milled out to clear the well site 100 for production and/or continuing operations. In many instances, the shape of the top of the fish is ambiguous or otherwise unknown, such that engaging the fish is difficult and time-consuming. Due to the difficulties associated with using a fishing tool and milling a fish, a device that can successfully prevent junk from entering the wellbore 102 and travelling downhole is beneficial. Accordingly, embodiments disclosed herein present devices and methods for protecting a well site 100 from falling junk.

Figure 2:
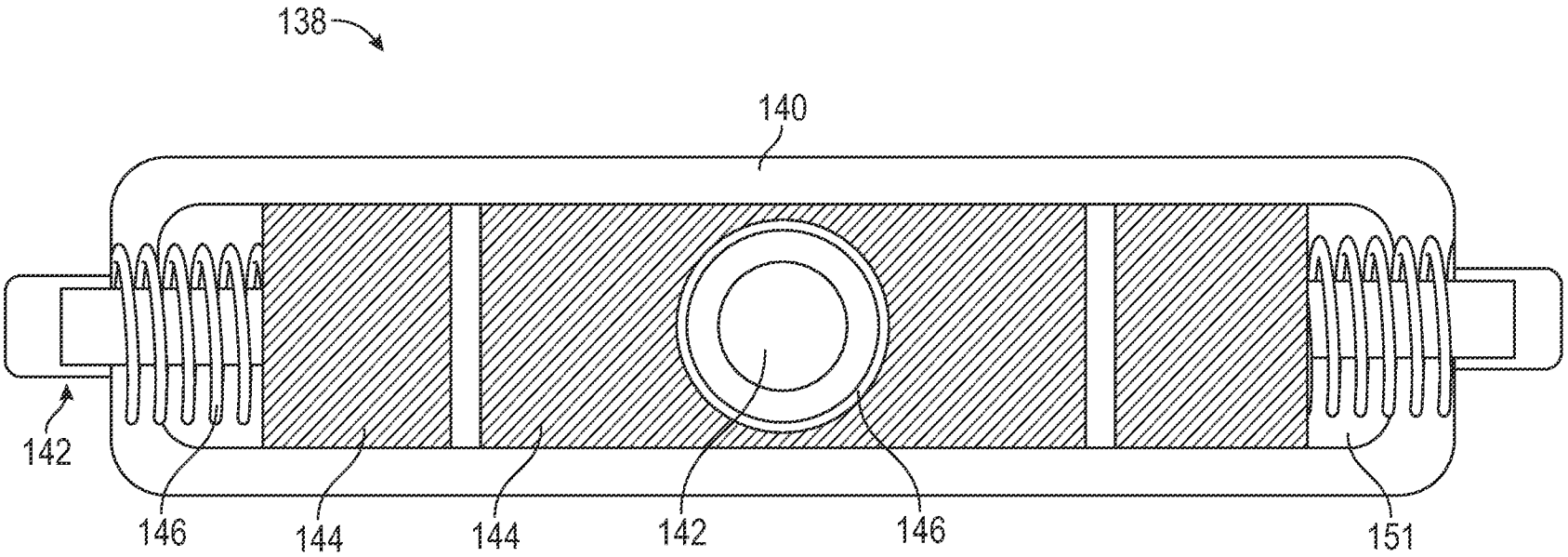
FIG. 2 shows a cross-sectional view of a wellbore protector ram in accordance with one or more embodiments of the present disclosure.

FIG. 2 shows a cross-sectional view of a wellbore protector ram 138 in accordance with one or more embodiments of the present disclosure. The wellbore protector ram 138 includes a body 140, a plurality of pistons 142, a plurality of blocks 144, and a plurality of springs 146. The body 140 is formed of steel or a similar high strength material. Further, the body 140 is cylindrical in shape and includes an opening 148. The opening 148 is configured to allow a drill string 108 to pass through the body 140.

A plurality of pistons 142 are attached to the body 140. The plurality of pistons 142 may be formed of low carbon steel or an aluminum alloy and each include a cylindrical body and a plunger. The cylindrical body of each piston 142 may be disposed on the exterior of the body 140, while the plunger of each piston 142 may move between the cylindrical body and the interior of the body 140. In addition, each plunger of the plurality of pistons 142 is attached to a single block 144 of the plurality of blocks 144. The plurality of pistons 142 are configured to lock the plurality of blocks 144 in place when actuated. In the embodiment depicted in FIG. 2, the plurality of pistons 142 are single acting pistons, which when actuated move in one direction. In other embodiments of the wellbore protector ram 138 device, another form of piston may be utilized, such as a double acting piston.

The plurality of blocks 144 are configured to press against the drill string 108, thereby covering the opening 148 of the body 140, and thus, preventing any junk from entering the wellbore 102 and passing through the device. By covering the opening 148 of the body 140, the plurality of blocks 144 also cover an annulus of the well site 100. An annulus is the annular spacing between the wellbore and the casing.

In the embodiment depicted in FIG. 2, each block 144 of the plurality of blocks 144 occupies 90 degrees of the opening 148 when pressed against the drill string 108. The plurality of blocks 144 may be formed completely of an elastomeric material or of a durable material, such as steel, with an elastomeric outer layer. In addition, an outer edge 150 of each block 144 that makes contact with the drill string 108 is shaped complementary to the drill string 108. In this way, each block 144 makes flush contact with the drill string 108 when the plurality of blocks 144 and drill string 108 are pressed together.

In addition, in one or more embodiments, the plurality of blocks 144 are further configured to clean the exterior of the drill string 108. As the plurality of blocks 144 are shaped to make flush contact with the drill string 108 when the plurality of blocks 144 are pressed against the drill string 108, any debris and mud clinging to the drill string 108 is removed by the plurality of blocks 144. That is, as the drill string 108 moves up and down through the wellbore 102 and also through the wellbore protector ram 138, debris and mud on the exterior of the drill string 108 is knocked off the drill string 108 as it cannot pass through the plurality of blocks 144.

In one or more embodiments, the plurality of blocks 144 move towards and are pressed against the drill string 108 by the plurality of springs 146. The plurality of springs 146 are disposed within the body 140 of the wellbore protector ram 138. Each of the springs 146 are attached to the body 140 at a first end and to the plurality of blocks 144 at a second end. At least one spring 146 is attached to each block 144. Further, the plurality of springs 146 are compression springs 146 and may be formed of high-carbon, alloy, or stainless steel. In addition, the plurality of blocks 144 remain pressed against the drill string 108 by the plurality of springs 146 until the plurality of pistons 142 are actuated.

Figure 3:
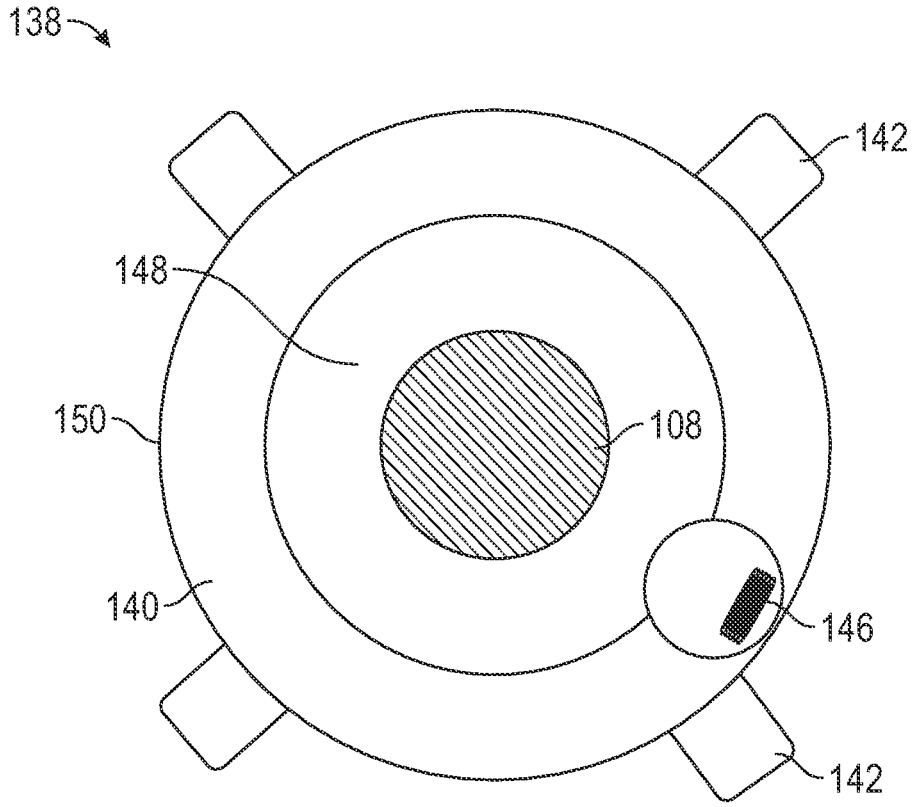
FIG. 3 shows a wellbore protector ram in an open position in accordance with one or more embodiments of the present disclosure.

FIG. 3 shows a wellbore protector ram 138 in an open position in accordance with one or more embodiments of the present disclosure. In this position, the plurality of pistons 142 are actuated. The plurality of pistons 142 may be actuated hydraulically and remotely controlled at the surface location. Upon actuation of the plurality of pistons 142, each plunger of the plurality of pistons 142 retracts away from the center of the body 140, within the cylindrical bodies of the plurality of pistons 142, thereby moving the attached plurality of blocks 144 towards an outer edge 150 of the body 140. In this embodiment, the plurality of blocks 144 are moved within a groove 151 of the interior of the body 140 when the device is in the open position such that the plurality of blocks 144 become hidden within the groove 151 of the body 140. In other embodiments, the interior of the body 140 may not include a groove 151, and the plurality of blocks 144 are moved only to the edge of the opening 148 by the plurality of pistons 142.

In the open position, the plurality of blocks 144 are locked within the groove 151 of the body 140 due to the actuation of the plurality of pistons 142 and, therefore, are prevented from moving. Additionally, in this position, the plurality of springs 146 are compressed due to the movement of the plurality of blocks 144 towards the outer edge 150 of the body 140. Furthermore, with the plurality of blocks 144 securely locked, a drill bit 112 attached to the lower end of the drill string 108 may pass through the opening 148 without coming into contact with the plurality of blocks 144.

Figure 4:
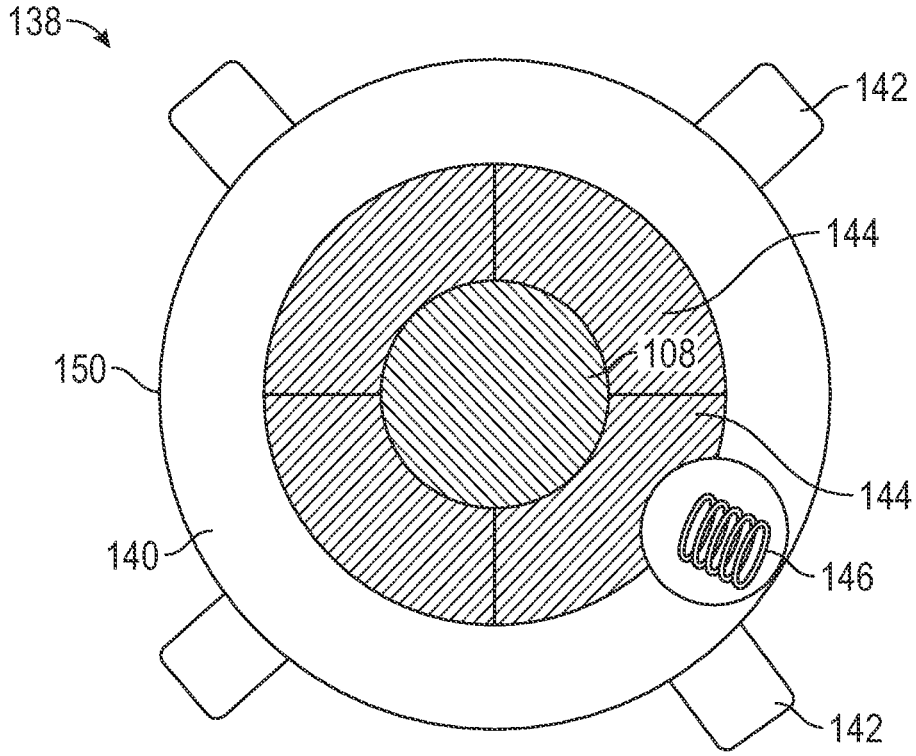
FIG. 4 shows a wellbore protector ram in a closed position in accordance with one or more embodiments of the present disclosure.

FIG. 4 shows a wellbore protector ram 138 in a closed position in accordance with one or more embodiments of the present disclosure. In this position, the plurality of pistons 142 are not actuated. Therefore, the plungers of each piston 142 are free to move, and do so with the plurality of blocks 144. The plurality of blocks 144 move once the plurality of pistons 142 are no longer actuated due to the decompression of the plurality of springs 146. The plurality of springs 146 move the blocks 144 towards the drill string 108 until contact is made between the plurality of blocks 144 and the drill string 108. In the closed position, the plurality of blocks 144 prevent junk from passing through the opening 148 of the body 140 by covering the opening 148 of the body 140 surrounding the drill string 108.

Figure 5:
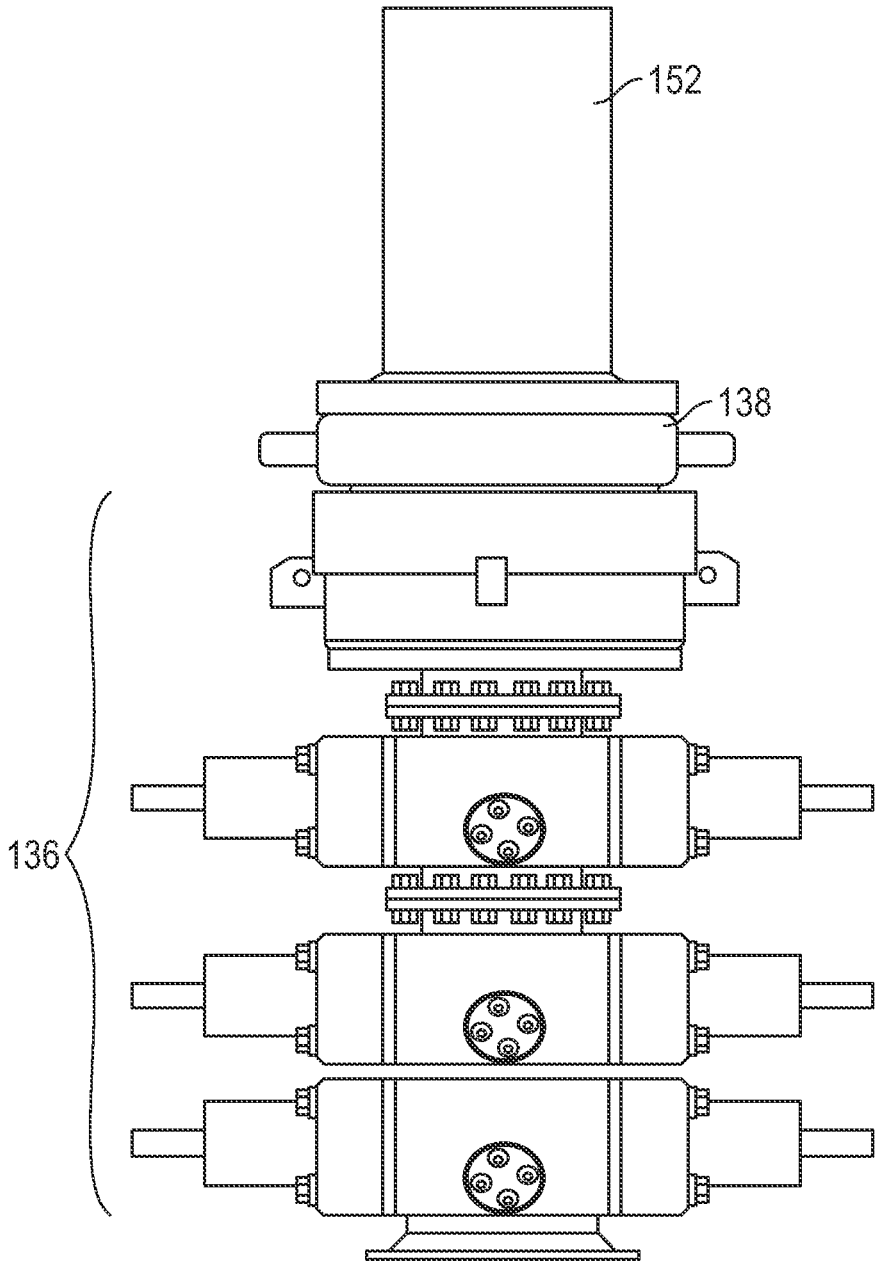
FIG. 5 shows a section of a well incorporating a wellbore protector ram in accordance with one or more embodiments of the present disclosure.

FIG. 5 shows a section of a well site 100 incorporating a wellbore protector ram 138 in accordance with one or more embodiments of the present disclosure. In this embodiment, the wellbore protector ram 138 is disposed between a bell nipple 152 and a BOP 136. The bell nipple 152 is a pipe formed of a durable material, such as steel, and configured to guide drilling tools into the top of the wellbore 102. Further, the bell nipple 152 is situated below the rig floor at the top of the casing. The wellbore protector ram 138 further includes an upper flange and lower flange disposed on the top side and bottom side of the body 144 of the wellbore protector ram 138 device, respectively. The top flange of the wellbore protector ram 138 connects the bell nipple 152 and the wellbore protector ram 138 device. The lower flange of the wellbore protector ram 138 connects the BOP 136 and the wellbore protector ram 138 device. Bolts formed of steel or a similar high strength material secure the upper flange and lower flange to the bell nipple 152 and BOP 136, respectively. At this location, the wellbore protector ram 138 device prevents junk from entering the BOP 136 of the well site 100, ensuring that the functionality of the BOP 136 remains intact.

Figure 6B:
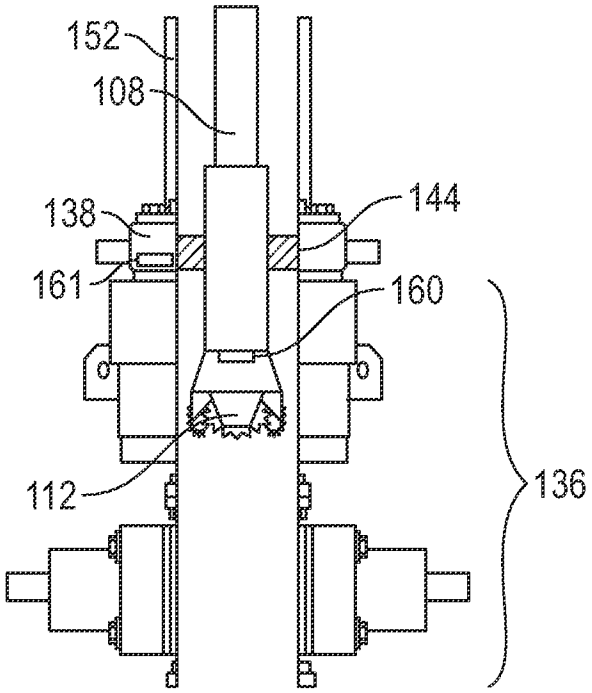
FIGS. 6A and 6B show diagrams depicting the operational sequence of the device in accordance with one or more embodiments.
Figure 6A:
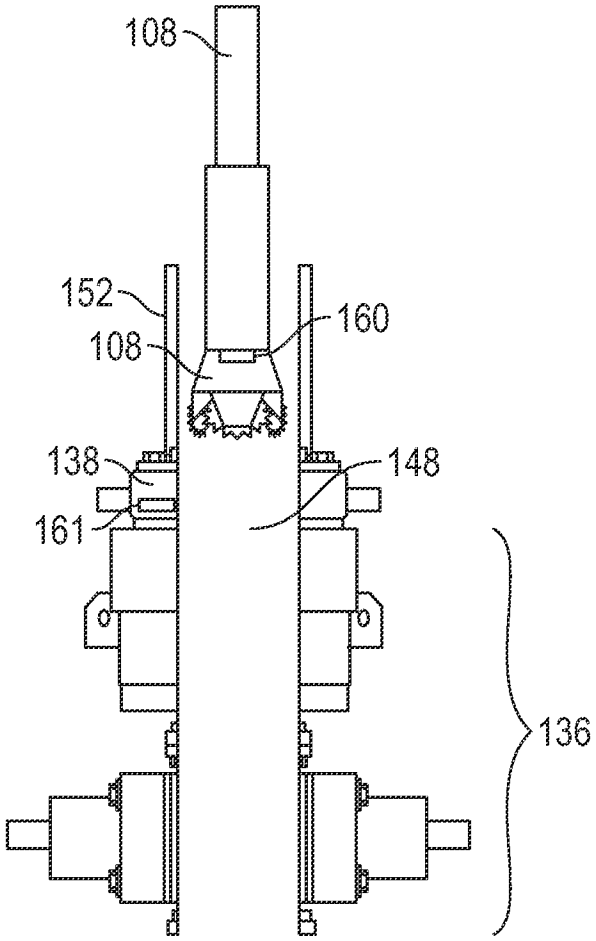

FIGS. 6A and 6B show diagrams depicting the operational sequence of the device in accordance with one or more embodiments. Specifically, FIGS. 6A and 6B show the section of the well site 100 of FIG. 5 before and after a drill bit 112 attached to a drill string 108 is passed through the opening 148 of the wellbore protector ram 138 device. Components of FIGS. 6A and 6B that are the same as or similar to components depicted in FIGS. 2-5 have not been redescribed for purposes of readability and have the same functions as those described above.

FIG. 6A depicts the wellbore protector ram 138 device in the open position prior to a drill string 108 being ran downhole through the device. The device remains in the open position until the drill bit 112 has completely passed through the opening 148 of the device. Subsequent to the drill bit 112 passing through the device, the plurality of pistons 142 unlock, freeing the plurality of blocks 144 to move towards the drill string 108. The plurality of pistons 142 unlock when they are no longer actuated. The actuation of the plurality of pistons 142 is controlled remotely from the surface location.

In one or more embodiments, depth monitoring sensors 160 may be disposed upon the drill bit 112 or the end of the drill string 108. In this way, the wellbore protector ram 138 device may be closed subsequent to the sensors 160 outputting a specified depth. In an additional embodiment, one or more RFID sensors 160 may be attached to the drill string 108 several feet above the drill bit 112 and the wellbore protector ram 138 device or another element of the well site 100 may include an RFID reader 161. In this way, the RFID sensors 160 and RFID reader 161 come into close proximity subsequent to the drill bit 112 passing through the wellbore protector ram 138 device. Consequently, when the RFID sensors 160 and RFID reader 161 are in close proximity, a signal may be sent to the surface location notifying that the wellbore protector ram 138 may be closed.

FIG. 6B depicts the wellbore protector ram 138 device in the closed position subsequent to the drill bit 112 passing through the opening 148 of the device. In this position, the plurality of blocks 144 are pressed against the drill string 108 by the plurality of springs 146, thereby covering the opening 148 of the body 140. In the closed position, the drill string 108 is configured to rotate and travel downwards and upwards within the wellbore 102. Accordingly, the plurality of springs 146 expand and compress in response to any changes in the diameter of the drill string 108. That is, the size of the opening 148 of the body 140 changes with the changes in the diameter of the drill string 108.

The wellbore protector ram 138 device may be opened by hydraulically and remotely actuating the plurality of pistons 142, locking the plurality of blocks 144 within the groove 151 of the body 140, subsequent to completion of the drilling operation or once the drill string 108 and drill bit 112 come into a specified proximity to the device while travelling upwards towards the device in the wellbore 102. Once the device is in the open position, the drill string 108 and drill bit 112 may pass through the opening 148 of the device and exit the wellbore 102 at the surface location.

Figure 7:
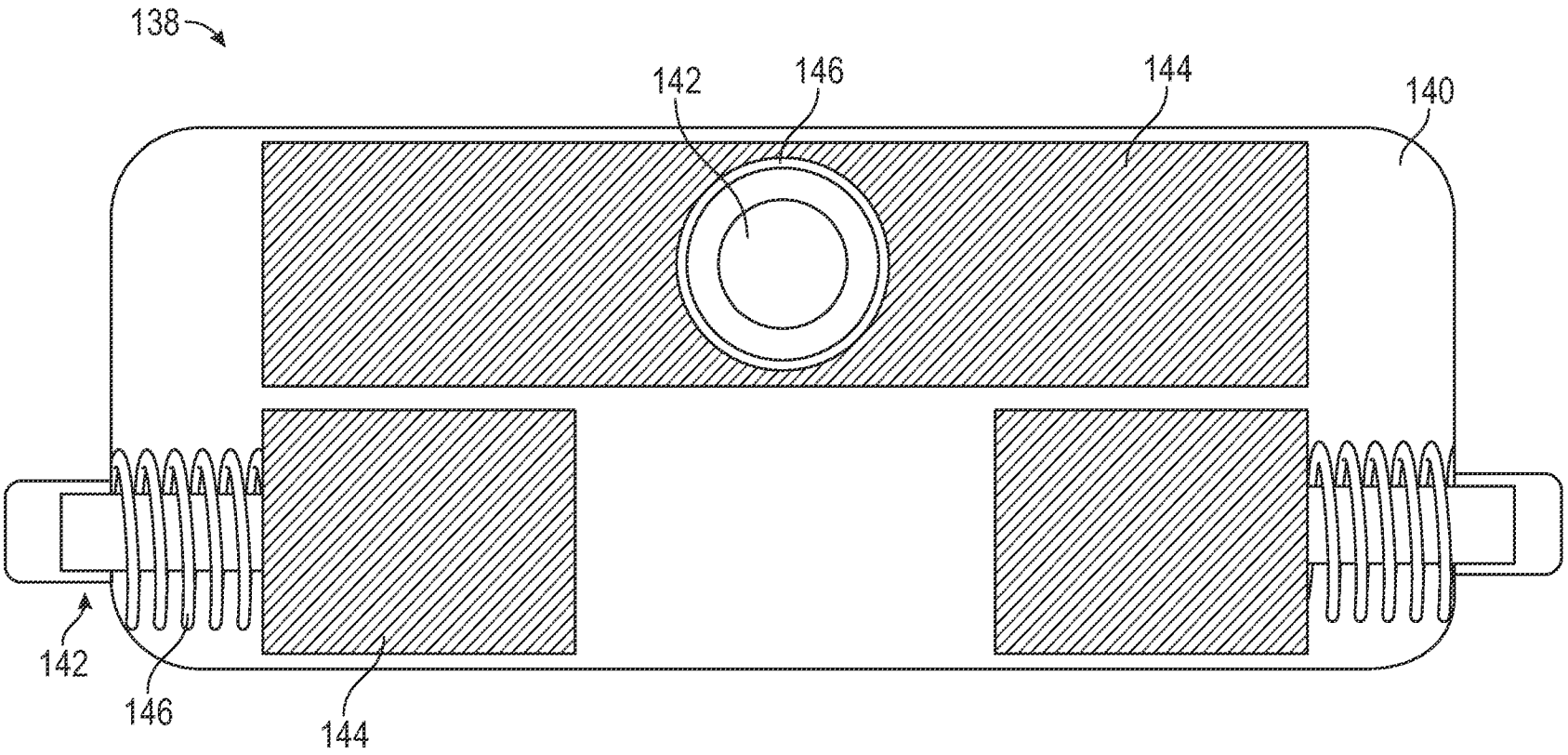
FIG. 7 shows a cross-sectional view of a wellbore protector ram in accordance with one or more embodiments of the present disclosure.

FIG. 7 depicts a cross-sectional view of another embodiment of a wellbore protector ram 138. In this embodiment, the wellbore protector ram 138 includes a plurality of blocks 144 disposed within multiple vertical planes. Consequently, the height of the body 140 of the device is increased in this embodiment in order to surround the plurality of blocks 144 in each plane. Further, in this embodiment, each plane includes two blocks 144 which move along a same axis by a plurality of pistons 142 or a plurality of springs 146 as described above. The two blocks 144 on a top plane move along a same axis that is perpendicular to a same axis the two blocks 144 on a bottom plane move along. In addition, the two blocks 144 of each plane are configured to cover the opening 148 of the body 140 when the wellbore protector ram 138 device is in the closed position and the plurality of blocks 144 are pressed against a drill string 108. In the embodiment depicted in FIG. 7, each block 144 of the plurality of blocks 144 occupies 180 degrees of the opening 148 when presses against the drill string 108.

In an embodiment in which the plurality of blocks 144 are disposed within a same vertical plane, such as depicted in FIGS. 2-4, as the plurality of springs 146 compress and expand, thus moving the plurality of blocks 144, with changes in the diameter of the drill string 108, gaps may appear between the plurality of blocks 144 as a result of the plurality of blocks 144 moving away from the center of the body 140. Consequently, junk may pass through these gaps if the junk is small enough to fit through the gaps. However, the embodiment depicted in FIG. 7 may be utilized to prevent such events from occurring. That is, junk is prevented from passing through the body 140 of the wellbore protector ram 138 because the two blocks 144 on each plane move along perpendicular axes and provide an additional line of defense blocking junk.

As the diameter of the drill string 108 changes while passing through the body 140, gaps may still form between the two blocks 144 in each plane while the plurality of blocks 144 move with the changes in the diameter of the drill sting. However, since the axes of movement between the two blocks 144 on the top plane and bottom plane are perpendicular, any junk that passed through the gaps between the two blocks 144 of the top plane will be prevented from passing through the gaps between the two blocks 144 of the bottom plane.

Figure 8:
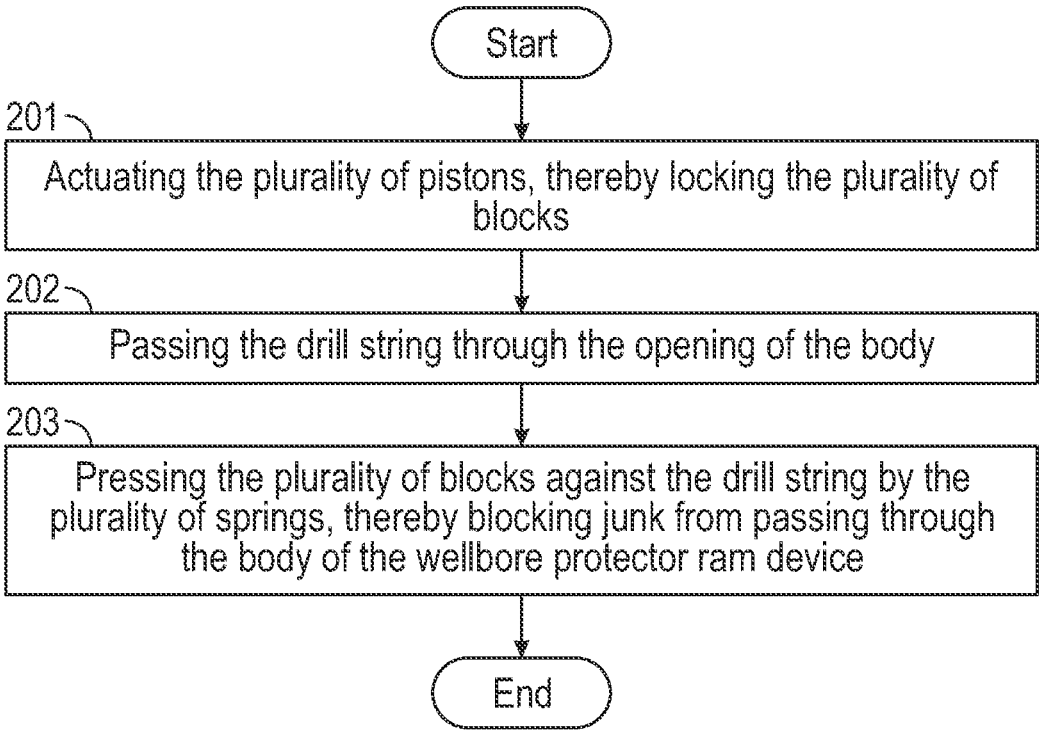
FIG. 8 shows a flowchart of a method in accordance with one or more embodiments of the present disclosure.

FIG. 8 depicts a flowchart showing a method of protecting a well site 100 from junk by covering the annulus of the well site 100 with a plurality of moveable blocks 144. While the various flowchart steps in FIG. 8 are presented and described sequentially, one of ordinary skill in the art will appreciate that some or all of the steps may be executed in different orders, may be combined or omitted, and some or all of the steps may be executed in parallel. Furthermore, the steps of the flowchart may be performed actively or passively.

In step 201, the wellbore protector ram 138 is placed in the open position. This is accomplished by actuating the plurality of pistons 142. The plurality of pistons 142 may be actuated hydraulically and remotely. During actuation, the plunger of each piston 142 retracts away from the center of the body 140 into the cylindrical body of each corresponding piston 142. In doing so, the attached plurality of blocks 144 also travel away from the center of the body 140, thereby increasing the size of the opening 148 of the body 140 and compressing the plurality of springs 146 between the plurality of blocks 144 and the body 140. Once the plurality of pistons 142 are actuated, the plurality of blocks 144 are locked in place and prevented from moving. In one or more embodiments, the plurality of blocks 144 may be locked within a groove 151 of the body 140.

In step 202, the drill string 108 is passed through the opening 148 of the body 140, subsequent to the wellbore protector ram 138 being placed in the open position. A drill bit 112 may be attached to the lower end of the drill string 108 and may also pass through the opening 148.

In step 203, the wellbore protector ram 138 is placed in the closed position. Subsequent to the drill bit 112 passing completely through the body 140, the plurality of blocks 144 are unlocked. In one or more embodiments, the drill bit 112 may include a depth monitoring sensor 160 that sends a signal to the surface location notifying that the drill bit 112 has reached a depth deeper than the position of the wellbore protector ram 138. In another embodiment, the wellbore protector ram 138 may also include a sensor 160 within the body 140.

After the plurality of pistons 142 unlock the plurality of blocks 144, freeing the plurality of blocks 144 to move, the plurality of springs 146 press the plurality of blocks 144 against the drill string 108. The drill string 108 continues to be ran downhole and rotate with the plurality of blocks 144 pressed against it. The plurality of springs 146 compress and expand, moving the plurality of blocks 144, with the changes in the diameter of the drill string 108, ensuring the plurality of blocks 144 remain in contact with the drill string 108 while the wellbore protector ram 138 is in the closed position. In the closed position, the plurality of blocks 144 cover the opening 148 of the body 140 surrounding the drill string 108 and therefore prevent junk from passing through the wellbore protector ram 138 into the downhole end of the wellbore 102 (step 203).

In addition, in the closed position, the plurality of blocks 144 clean the drill string 108. That is, as the drill string 108 moves up and down in the wellbore 102 and through the wellbore protector ram 138, any debris or mud disposed on the exterior of the drill string 108 is knocked off by the plurality of blocks 144. The plurality of blocks 144 are in flush contact with the drill string 108 while in the closed position and debris and mud are scraped off as the drill string 108 moves through the opening 148.

Accordingly, the aforementioned embodiments as disclosed relate to devices useful for protecting a well site 100 from fish or junk entering the wellbore 102 by covering the annulus of the well site 100 with a plurality of moveable blocks 144. The disclosed devices for and methods of protecting a well site 100 from junk advantageously eliminates the need for fishing jobs. This benefit, in turn, advantageously reduces additional rig time and associated costs. In addition, the disclosed devices for and methods of protecting a well site 100 from junk advantageously cleans the drill string 108 of the well site 100.

Although only a few embodiments of the invention have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A wellbore protector ram device, comprising:

a plurality of blocks configured to move in a plane orthogonal to an extension direction of a drill string and block junk from passing through a body of the wellbore protector ram device;

a plurality of pistons configured to actuate, thereby locking and preventing movement of the plurality of blocks; and a plurality of springs configured to press the plurality of blocks against the drill string when the plurality of blocks are unlocked, the drill string being configured to rotate and travel along the extension direction of the drill string within a wellbore when the plurality of blocks are unlocked and when the plurality of blocks are locked;

wherein the body is configured to encase the plurality of pistons and a plurality of springs, the body comprising an opening permitting passage of the drill string through the body; and wherein the body is fixed between a bell nipple and a blowout preventer.

2. The wellbore protector ram device according to claim 1, wherein each piston of the plurality of pistons is operatively connected to a corresponding block of the plurality of blocks.

3. The wellbore protector ram device according to claim 1, wherein each block of the plurality of blocks is connected to at least one spring of the plurality of springs.

4. The wellbore protector ram device according to claim 1, wherein an outer surface of each block that contacts the drill string is shaped complementary to the drill string such that each block is in flush contact with the drill string when the plurality of blocks are pressed against the drill string.

5. The wellbore protector ram device according to claim 4, wherein the plurality of blocks are formed of an elastomer material.

6. The wellbore protector ram device according to claim 1, wherein the plurality of pistons are configured to move and lock the plurality of blocks into the body, thereby increasing a size of the opening.

7. The wellbore protector ram device according to claim 6, wherein the plurality of pistons are hydraulically actuated.

8. The wellbore protector ram device according to claim 7, wherein the plurality of pistons are actuated via a remote command.

9. The wellbore protector ram device according to claim 6, wherein the plurality of blocks are configured to unlock subsequent to an end of the drill string passing through the opening of the body and surround the drill string in a radial direction.

10. The wellbore protector ram device according to claim 9, wherein the wellbore protector ram device further comprises a sensor configured to communicate with a computer system disposed at a surface location subsequent to a drill bit attached to the drill string passing through the opening of the body.

11. A method comprising:

actuating a plurality of pistons of a wellbore protector ram device, the plurality of pistons being operatively connected to a plurality of blocks, wherein actuating the plurality of pistons results in locking and preventing movement of the plurality of blocks;

passing a drill string through an opening of a body of the wellbore protector ram device, the body being fixed between a bell nipple and a blowout preventer, and configured to encase the plurality of pistons and a plurality of springs; and pressing the plurality of blocks against the drill string in a plane orthogonal to an extension direction of the drill string by the plurality of springs when the plurality of blocks are unlocked, such that the plurality of blocks block junk from passing through the body of the wellbore protector ram device;

wherein the drill string is configured to rotate and travel along the extension direction of the drill string within a wellbore when the plurality of blocks are unlocked and when the plurality of blocks are locked.

12. The method according to claim 11, wherein the plurality of pistons are hydraulically actuated.

13. The method according to claim 12, wherein the plurality of pistons are remotely actuated.

14. The method according to claim 11, wherein actuating the plurality of pistons comprises moving the plurality of blocks by the plurality of pistons away from a center of the body in the plane orthogonal to the extension direction of the drill string.

15. The method according to claim 14, wherein actuating the plurality of pistons further comprises compressing the plurality of springs.

16. The method according to claim 14, wherein actuating the plurality of pistons further comprises increasing a size of the opening.

17. The method according to claim 16, further comprising decreasing the size of the opening by pressing, with the plurality of springs, the plurality of blocks towards the drill string when the plurality of blocks are unlocked.

18. The method according to claim 14, further comprising locking the plurality of blocks in an open position by actuating the plurality of pistons prior to passing the drill string through the opening.

19. The method according to claim 18, further comprising, subsequent to a drill bit attached to the drill string passing through the opening, pressing the plurality of blocks against the drill string by the plurality of springs.

20. The method according to claim 19, wherein pressing the plurality of blocks against the drill string by the plurality of springs comprises expanding and compressing the plurality of springs in response to changes in a diameter of the drill string such that a size of the opening changes with the changes in the diameter of the drill string.

* * * * *